United States Patent [19]

Suganami et al.

[11] Patent Number: 4,817,390

[45] Date of Patent: Apr. 4, 1989

[54] CRYOGENIC COMPRESSOR

[75] Inventors: Takuya Suganami; Yoshio Kazumoto, both of Hyogo, Japan

[73] Assignee: Mitsubishi Denki Kabushiki Kaisha, Tokyo, Japan

[21] Appl. No.: 123,964

[22] Filed: Nov. 23, 1987

[30] Foreign Application Priority Data

Dec. 16, 1986 [JP] Japan ..... 61-299309

[51] Int. Cl.[4] ..... F25B 9/00

[52] U.S. Cl. ..... 62/6; 60/520; 417/439

[58] Field of Search ..... 62/6; 60/520; 417/439

[56] References Cited

U.S. PATENT DOCUMENTS

| | | | |
|---|---|---|---|
| 3,640,082 | 2/1972 | Dehne | 417/439 |
| 3,793,846 | 2/1974 | Dehne | 62/6 |
| 4,024,727 | 5/1977 | Berry et al. | 62/6 |
| 4,498,296 | 2/1985 | Dijrstra et al. | 62/6 |

OTHER PUBLICATIONS

"Overview of Free-Piston Stirling SP-100 Activities at the NASA Lewis Research Center" paper 86-1-30, Proc. of the 3rd ISEC, 3/1986.

"Cryocoolers (II)" G. Walker, Plenum Press, New York: 3/1983.

*Primary Examiner*—Ronald C. Capossela

*Attorney, Agent, or Firm*—Wolf, Greenfield & Sacks

[57] ABSTRACT

A cryogenic compressor wherein a compression space and a buffer space which are partitioned off from each other by means of a reciprocating piston are directly connected together through a passage which is provided with a check valve that allows a gas to flow only from the buffer space to the compression space and a purification chamber filled with a purifying substance. Thus, when the pressure within the compression space is about to become lower than the pressure within the buffer space, the gas is led from the buffer space to the compression space via the passage which connects these spaces directly to each other through the check valve, and even if this gas has been contaminated, it is purified by the purifying substance charged in the purification chamber and therefore the contamination of the working gas is prevented.

26 Claims, 3 Drawing Sheets

CRYOGENIC COMPRESSOR

BACKGROUND OF THE INVENTION

1. Field of the Invention

The present invention relates to a cryogenic compressor for use in machines designed to generate cryogenic temperatures, for examples, stirling cryogenic apparatuses 2. Description of the Relates Art Machines which are adapted for generating cryogenic temperatures, i.e., stirling cryogenic apparatuses, employ a cryogenic compressor having a reciprocating piston as one of the principal constituent elements. This compressor is generally designed to compress a gas such as helium gas. This sort of conventional crank type compressor will be described hereinunder with reference to FIGS. 4 to 6.

Referring to FIGS. 4 and 5, the reference numeral 1 denotes an electric motor which drives a crankshaft 2. A connecting rod 3 has its large end portion fitted and thereby supported on an eccentric portion of the crankshaft 2 through a bearing 4. A piston 5 is connected to the small end portion of the connecting rod 3 so that the piston 5 is reciprocatable within a cylinder 6. A piston ring 7 is fitted on the piston 5 so as to seal the clearance space between the piston 5 and the cylinder 6. A bearing 8 is provided so as to bear the crankshaft 2 on a motor casing 9. A crank case 10 is provided between the cylinder 6 and the casing 9, and a gas pipe 11 is connected to the top of the cylinder 6. The reference numeral 12 denotes a compression space which is defined within the cylinder 6, while the numeral 13 denotes a buffer space defined within the crank case 10, and these spaces 12 and 13 are partitioned off from each other by the piston 5 and the piston ring 7.

In the cryogenic compressor arranged as described above, as the motor 1 is activated, the crankshaft 2 is rotated, and the piston 5 is reciprocated within the cylinder 6 through the connecting rod 3, thereby repeating compression and expansion of the compression space 12, and thus effecting discharge and suction of working gas through the gas pipe 11. In response to this operation, the gas pressure $P_C$ within the compression space 12 changes toward both high- and low-pressure sides with respect to the gas pressure $P_B$ within the buffer space 13 in accordance with the crank angle as shown in FIG. 6, and in accordance with the change in the gas pressure $P_C$, the bearing load, connecting rod load and piston lateral pressure also change toward both high- and low-pressure sides as shown in FIG. 6. In this figure, the crank angle is set in such a manner that the angle which is made when the piston is at the top dead center is 0°.

The conventional cryogenic compressor is arranged as detailed above, and the gas pressures within the compression and buffer spaces change as shown in FIG. 6, thus causing the working gas to be breathed in and out between the compression and buffer spaces. This breathing action involves the problem that the gas in the buffer space, which is contaminated by contaminative particles such as those which are generated from wearing caused by the slide contact between the piston ring and the cylinder and which drop gravitationally to float within the buffer space, may enter the compression space to contaminate the working gas, resulting in the function of the cooling cycle being damaged. Further, since the direction of change of each of the bearing load, connecting rod load and piston lateral pressure changes in accordance with the crank angle, an impulsive sound may be generated due to clearance spaces which are present at the bearings, connecting rod and piston unit. In addition, the impact accelerates the wear of each of the above-described parts, resulting in the life of the compressor being shortened.

SUMMARY OF THE INVENTION

In view of the above-described problems of the prior art, it is a primary object of the present invention to provide a cryogenic compressor which is so designed that it is possible to prevent the contamination of the working gas and reduce the impulsive sound as well as minimize the wear of the bearings, connecting rod and piston unit simply by additionally providing members having simple structures.

To this end, the present invention provides a cryogenic compressor having a compression space and a buffer space which are partitioned off from each other by means of a reciprocating piston, wherein the improvement comprises: a passage which connects the compression and buffer spaces directly to each other; a check valve provided in the passage, the valve allowing a gas to flow only from the buffer space to the compression space; and a purification chamber provided in the passage and in series to the check valve, the chamber being filled with a purifying substance.

Thus, in the cryogenic compressor according to the present invention, when the pressure within the compression space is about to become lower than the pressure within the buffer space, the gas is led from the buffer space to the compression space via the passage which connects these spaces directly to each other through the check valve, and even if this gas has been contaminated, it is purified by the purifying substance charged in the purification chamber and therefore the contamination of the working gas is prevented. Further, in the cryogenic compressor of the present invention, the gas pressure within the compression space is kept equal to or higher than the gas pressure within the buffer space at all times by the action of the check valve, and the gas therefore flows in one direction through the following circuit: the compression space → the clearance space between the piston ring and the cylinder → the buffer space → the passage → the compression space. Thus, there is no fear of the gas being breathed in and out between the compression and buffer spaces as in the case of the conventional cryogenic compressor, and each of the bearing and connecting rod loads changes only at one pressure side. There is therefore no fear of an impact or an impusive sound being generated, which would otherwise be caused due to clearance spaces which are present at the bearings and the connecting rod. Further, it is possible to form the cryogenic compressor according to the present invention simply by adding a pipe, a check valve and a purification chamber which constitute in combination a passage to a conventional cryogenic compressor, and these members which are to be added are simple in structure advantageously.

The above and other objects, features and advantages of the present invention will become more apparent from the following description of the preferred embodiment thereof taken in conjunction with the accompanying drawings.

DESCRIPTION OF THE PREFERRED EMBODIMENT

One preferred embodiment of the present invention will be described hereinunder in detail with reference to FIGS. 1 to 3.

Figure 1:
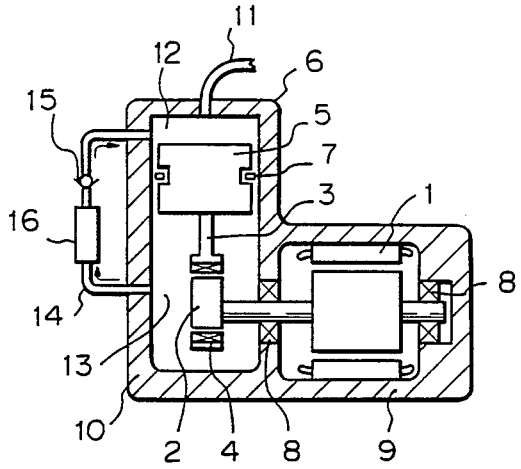
FIG. 1 is a schematic sectional side view of a cryogenic compressor in accordance with one embodiment of the present invention.
Figure 2:
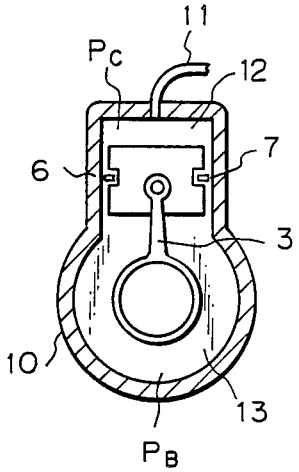
FIG. 2 is a schematic sectional front view of the cryogenic compressor shown in FIG. 1.
Figure 4:
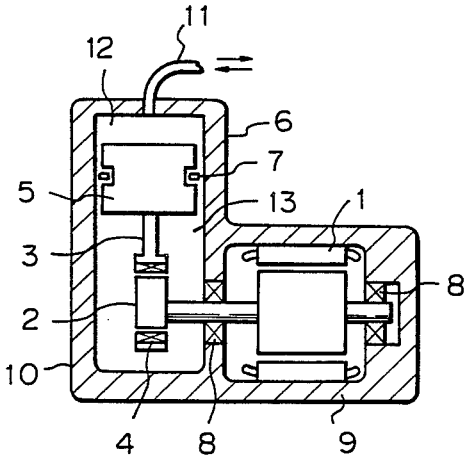
FIG. 4 is a schematic sectional side view of a conventional cryogenic compressor.
Figure 5:
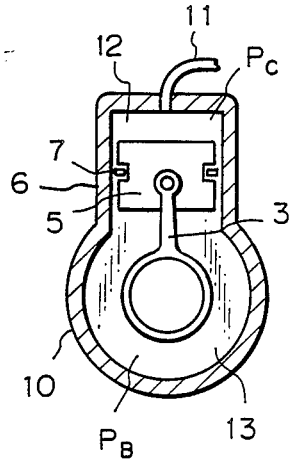
FIG. 5 is a schematic sectional front view of the cryogenic compressor shown in FIG. 4.
Figure 3:
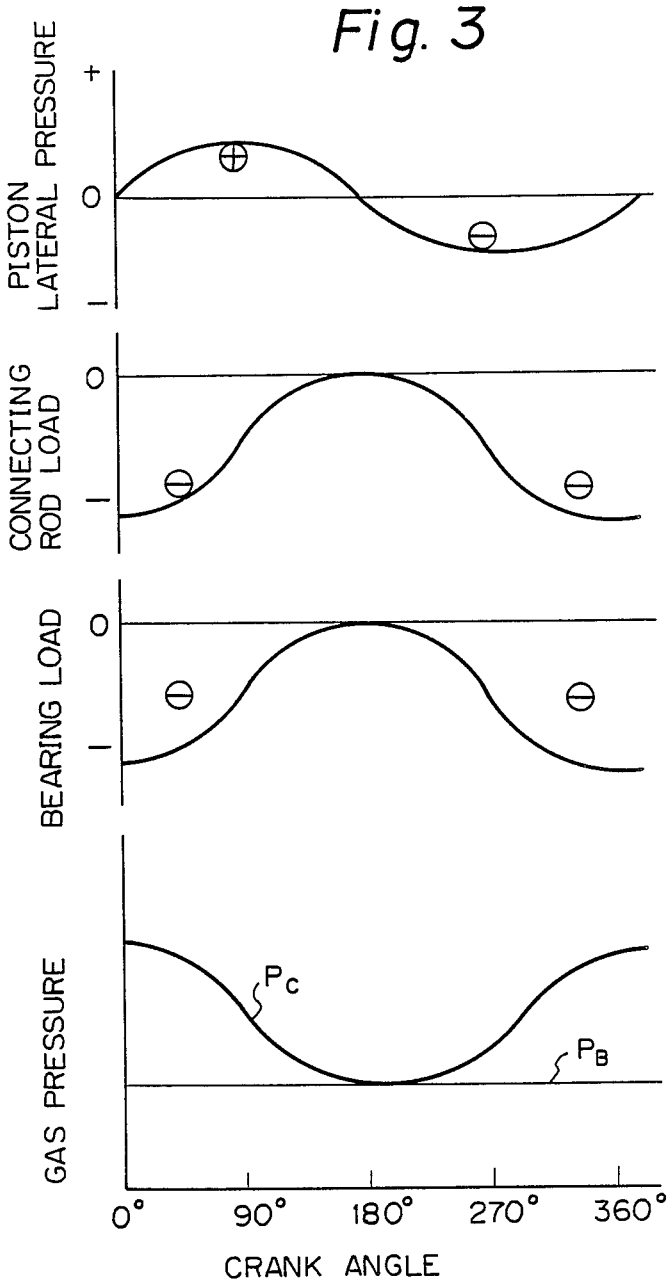
FIG. 3 shows graphs employed to describe the operation of the cryogenic compressor shown in FIGS. 1 and 2.
Figure 6:
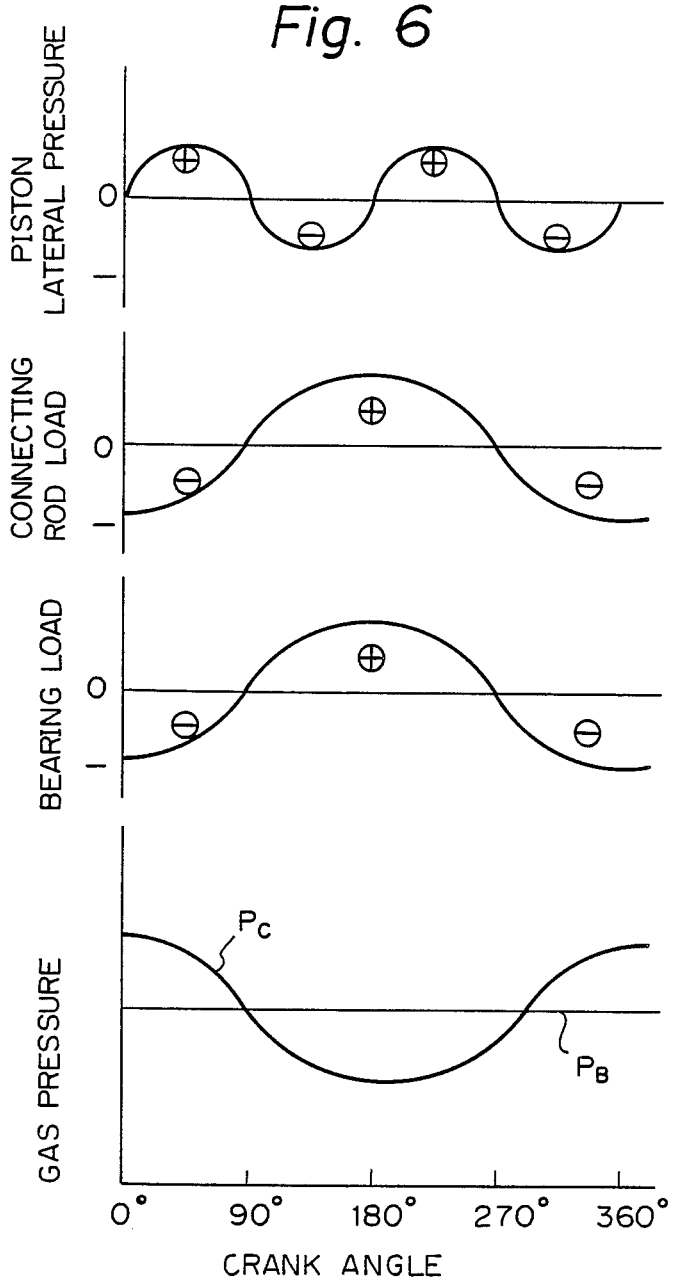
FIG. 6 shows graphs employed to describe the operation of the conventional cryogenic compressor.

Referring first to FIGS. 1 and 2, the electric motor 1, the crankshaft 2 and the connecting rod 3 are the same as those in the conventional cryogenic compressor shown in FIGS. 4 and 5. The reference numeral 14 denotes a passage which connects the compression space 12 directly to the buffer space 13. The passage 14 is provided with a check valve 15 which allows the gas to flow only from the buffer space 13 to the compression space 12. The reference numeral 16 denotes a purification chamber which is provided in the passage 14 on the side thereof which is closer to the buffer space 13 than the check valve 15. The purification chamber 16 is filled with a gas purifying substance such as molecular sieves, filter or the like. The arrangement of the other part of this embodiment is the same as that of the conventional cryogenic compressor shown in FIGS. 4 and 5.

The following is a description of the operation of the cryogenic compressor according to this embodiment arranged as described above.

As the crankshaft 2 is rotated by driving the motor 1, the piston 5 is reciprocated within the cylinder 6 to repeat compression and expansion of the compression space 12. When the gas pressure $P_C$ within the compression space 12 is higher than the gas pressure $P_B$ within the buffer space, the gas leaks from the compression space 12 to the buffer space 13 through the clearance space between the piston ring 7 and the cylinder 6 in he same way as in the prior art. However, when the gas pressure $P_C$ within the compression space 12 is about to become lower than the gas pressure $P_B$ within the buffer space 13, the gas is led from the buffer space 13 to the compression space 12 via the passage 14 which directly connects the to spaces 12, 13 and through the check valve 15. Accordingly, as shown in the graphs of FIG. 3 in which the crank angle is set in such a manner that the angle which is made when the piston is at the top dead center is 0°, the gas pressure $P_C$ within the compression space 12 is kept equal to or higher than the gas pressure $P_B$ within the buffer space 13 at all time, and the gas therefore flows in one direction through the following circuit: the compression space 12 → the clearance gap between the piston ring 7 and the cylinder 6 → the buffer space 13 → the passage 14 → the compression space 12. Thus, there is no fear of the gas being breathed in and out between the compression and buffer spaces as in the case of the conventional cryogenic compressor, and the gas which is contaminated by particles which are generated from wearing caused by the slide contact between the piston ring 7 and the cylinder 6 and which drop into the buffer space 13 to flat therein is invariably passed through the purification camber 16. Therefore, contaminative particles such as wear particles are removed from the gas by means of the purifying substance charged in the purification chamber 16, and the purified gas alone is led to the compression space 12 through the check valve 15. Further, as shown in FIG. 3, each o the bearing and connecting rod loads changes only at one pressure side, and there is therefore no fear of an impact or a impulsive sound being generated, which would otherwise be caused due to clearance spaces which are present at the bearing and the connecting rod.

As has been described above, the present invention provides a cryogenic compressor wherein a compression space and a buffer space which are partitioned off from each other by means of a reciprocating piston are directly connected together through a passage which is provided with a check valve and a purification chamber filled with a purifying substance in series. Therefore, it is only necessary to add a pipe, a check valve and a purification chamber which constitute in combination a passage to a conventional cryogenic compressor without any need to change the arrangement of the conventional compressor. In addition, the above-described members to be added are simple in structure and can be obtained at relatively low costs, yet it is possible to purify the contaminated gas by means of the purifying substance charged in the purification chamber and lead the purified gas t the compression space. Further, it is possible to suppress the generation of an impulsive sound and an impact due to clearance spaces which are present at the bearings and the connecting rod and to thereby decelerate the wear of these parts. Thus, it is possible to extend the life of the constituent elements, advantageously.

Although the present invention has been described through specific terms, it should be noted here that the described embodiment is not necessarily limitative and various change and modifications may be imparted thereto without departing from the scope of the invention which is limited solely by the appended claim.

What is claimed is:

1. A cryogenic compressor having a compression space and a buffer space which are partitioned off from each other by means of a reciprocating piston, wherein the improvement comprises:
   - a passage which connects said compression and buffer spaces directly to each other;
   - a check valve provided in said passage, said valve allowing a gas to flow only from said buffer space to said compression space; and
   - a purification chamber provided in said passage and in series with said check valve, said chamber being filled with a purifying substance.

2. A cryogenic compressor according to claim 1, wherein said purification chamber is installed between said buffer space and said check valve.

3. A cryogenic compressor according to claim 1, wherein said purification chamber is filled with molecular sieves.

4. A cryogenic compressor according to claim 1, wherein a filter is attached within said purification chamber.

5. A cryogenic compressor according to claim 1, wherein said compressor space is placed above said buffer space.

6. A cryogenic compressor according to claim 1, wherein the gas pressure within said compression space is kept equal to or higher than the gas pressure within said buffer space while said cryogenic compressor is in operation.

7. A cryogenic compressor to claim 1 wherein said check valve opens and closes on the basis of the pressure difference between said compression and buffer spaces to control gas pressure so that the gas pressure within the compression space is always at least equal to the gas pressure within the buffer space.

8. A cryogenic compressor according to claim 7 wherein said purification chamber is disposed upstream of said check valve so that the circuilated gas is purified before passing through said check valve.

9. A cryogenic compressor according to claim 7 wherein said check valve controls gas pressure so that only when the gas pressure within the compression chamber is lower than the gas pressure within the buffer space is the check valve open so as to feed gas from the buffer space to the compression space.

10. A cryogenic compressor according to claim 9 wherein the check valve operates to equalize the gas pressure between the compression and buffer spaces over a limited segment of the reciprocating piston translation.

11. A cryogenic compressor according to claim 10 wherein the gas pressure between the compression and buffer spaces is equalized when the compression space gas pressure is at a minimum.

12. A cryogenic compressor according to claim 11 wherein the gas pressure between the compression and buffer spaces is equalized about the bottom dead center position of the piston.

13. A compressor comprising, a housing, a pisto supported in the housing for reciprocal motion therein and partitioning the housing into a compression space and a buffer space, means defining a coupling passage which connects said compression and buffer spaces, one-way valve means provided in said coupling passage, said one-way valve means allowing a gas to flow only from said buffer space to said compression space, and means defining a purification chanber disposed in said coupling passage in series with said one-way valve means, said purification chamber having a purifying substance.

14. A cryogenic compressor according to claim 13 wherein said purification chamber is disposed between said buffer space and said valve means.

15. A Cryogenic Compressor according to claim 13 wherein said purifying substance comprises molecular sieves.

16. A Cryogenic Compressor according to claim 13 wherein said purification chamber also comprises a filter within said chamber.

17. A Cryogenic Compressor according to claim 13 wherein said compressor space is disposed above said buffer space.

18. A Cryogenic Compressor according to claim 13 wherein the gas pressure within the compression space is maintained equal to or higher than the gas pressure within said buffer space while said Cryogenic Compressor is in operation.

19. A Cryogenic Compressor according to claim 13 wherein said valve means comprises a one way check valve to allow gas to flow only from said buffer space to said compression space.

20. A Cryogenic Compressor according to claim 13 wherein said coupling passage interconnects externally between ports of the housing.

21. A cryogenic compressor according to claim 13 wherein said one-way valve means opens and closes on the basis of the pressure difference between said compression and buffer spaces to control gas pressure so that the gas pressure within the compression space is always at least equal to the gas pressure within the buffer space.

22. A cryogenic compressor according to claim 21 wherein said purification chamber is disposed upstream of said one-way valve means so that the circuilated gas is purified before passing through said one-way valve means.

23. A cryogenic compressor according to claim 21 wherein said one-way valve means controls gas pressure so that only when the gas pressure within the compression chamber is lower than the gas pressure within the buffer space is the one-way valve means open so as to feed gas from the buffer space to the compression space.

24. A cryogenic compressor according to claim 23 wherein the one-way valve means operates to equalize the gas pressure between the compression and buffer spaces over a limited segment of the reciprocating piston translation.

25. A cryogenic compressor according to claim 24 wherein the gas pressure between the compression and buffer spaces is equalized when the compression space gas pressure is at a minimum.

26. A cryogenic compressor according to claim 25 wherein the gas pressure between the compression and buffer spaces is equalized about the bottom center position of the piston.

* * * * *